United States Patent [19]

Watanabe et al.

[11] Patent Number: 4,532,767

[45] Date of Patent: Aug. 6, 1985

[54] ENGINE COMPRESSOR HAVING A STIRLING CYCLE ENGINE

[75] Inventors: Tetsumi Watanabe, Okazaki; Shigenori Haramura, Toyoake; Yutaka Momose, Anjyo, all of Japan

[73] Assignee: Aisin Seiki Kabushiki Kaisha, Kariya, Japan

[21] Appl. No.: 680,589

[22] Filed: Dec. 11, 1984

Related U.S. Application Data

[63] Continuation of Ser. No. 376,218, May 7, 1982, abandoned.

[30] Foreign Application Priority Data

May 9, 1981 [JP] Japan ..... 56-70020

[51] Int. Cl.[3] ..... F02G 1/04

[52] U.S. Cl. ..... 60/525; 60/517; 417/397

[58] Field of Search ..... 60/517, 525, 526; 417/364, 397

[56] References Cited

U.S. PATENT DOCUMENTS 3,414,187 12/1968 McMullin et al. ..... 417/364
3,811,283 5/1974 Hartmann et al. ..... 60/525 X
4,030,404 6/1977 Meijer ..... 60/525

FOREIGN PATENT DOCUMENTS 52-31250 3/1977 Japan ..... 60/525

*Primary Examiner*—Allen M. Ostrager
*Attorney, Agent, or Firm*—Burns, Doane, Swecker & Mathis

[57] ABSTRACT

An engine-compressor comprising a stirling engine which includes a plurality of working cylinders, a plurality of working pistons respectively disposed in the working cylinders for axial reciprocating movements to thereby divide each of the cylinders into an expansion space and a compression space, the expansion space in one of the cylinders being connected through a heating device and a heat accumulating device with the compression space in another cylinder, a plurality of guide cylinders, a plurality of guide pistons disposed respectively in the guide cylinders for axial reciprocating movements, the guide piston being connected through piston rods with respective ones of the working pistons, and a swash plate or a crank device for converting the axial reciprocating movement of the guide piston into a rotating movement; a compressor including compression chambers defined in respective ones of the guide cylinders by the guide piston, intake valves provided in the compression chambers for admitting air thereto, and outlet valves provided in the compression chambers for taking the air out of the compression chambers.

4 Claims, 3 Drawing Figures

ENGINE COMPRESSOR HAVING A STIRLING CYCLE ENGINE

This application is a continuation, of application Ser. No. 376,216, filed May 7, 1982 now abandoned.

The present invention relates to an engine-compressor in which compressor means is associated with engine means so that the former is driven by the latter.

Conventionally, an engine-compressor includes an engine having an output shaft connected through a transmission device with a driven shaft of a compressor. It has been recognized that the conventional engine-compressor is disadvantageous as compared with an electric motor driven compressor in that the former is bulky and large in weight and the overall efficiency is low. Further, the engine-compressor which utilizes an internal combustion engine has significant vibrations and noise so that it can be used only in limited areas.

It is therefore an object of the present invention to provide an engine-compressor which is compact and light in weight but has a high overall efficiency.

Another object of the present invention is to provide an engine-compressor which is quiet in operation and has a satisfactory durability.

A further object of the present invention is to provide an engine-compressor which utilizes a stirling engine as the driving power source.

According to the present invention, the above and other objects can be accomplished by an engine-compressor comprising a stirling engine which includes a plurality of working cylinders, a plurality of working pistons respectively disposed in said working cylinders for axial reciprocating movements to thereby divide each of the cylinders into an expansion space and a compression space, the expansion space in one of the cylinders being connected through heating means and heat accummulating means with the compression space in another cylinder, a plurality of guide cylinders, a plurality of guide pistons disposed respectively in said guide cylinders for axial reciprocating movements, said guide pistons being connected through piston rods with respective ones of the working pistons, and means for converting the axial reciprocating movement of the guide piston into a rotating movement; a compressor including at least one compression chamber defined in at least one of the guide cylinders by the guide piston, intake valve means provided in said compression chamber for admitting air thereto, and outlet valve means provided in said compression chamber for taking the air out of the compression chamber.

In a preferable aspect of the present invention, the working cylinders are arranged in a circle and the guide cylinders are respectively arranged so that they are axially aligned with corresponding ones of the working cylinders so that the guide pistons are respectively connected with axially aligned ones of the working pistons. The converting means may be a swash plate which is rotatable about an axis parallel with the cylinders and passing through center of the circle along which the working cylinders are arranged, said swash plate being slidably engaged at its periphery with the guide pistons. Alternatively, the converting means may be crank means.

Preferably, each of the guide cylinders has compression chambers defined at the opposite sides of the guide piston disposed therein. The intake valve means may be in the form of a check valve which opens only in the direction of the compression chamber. Similarly, the outlet valve means is also in the form of a check valve which allows an airflow out of the compression chamber.

The above and other objects and features of the present invention will become apparent from the following descriptions of preferred embodiments taking reference to the accompanying drawings, in which.

Figure 1:
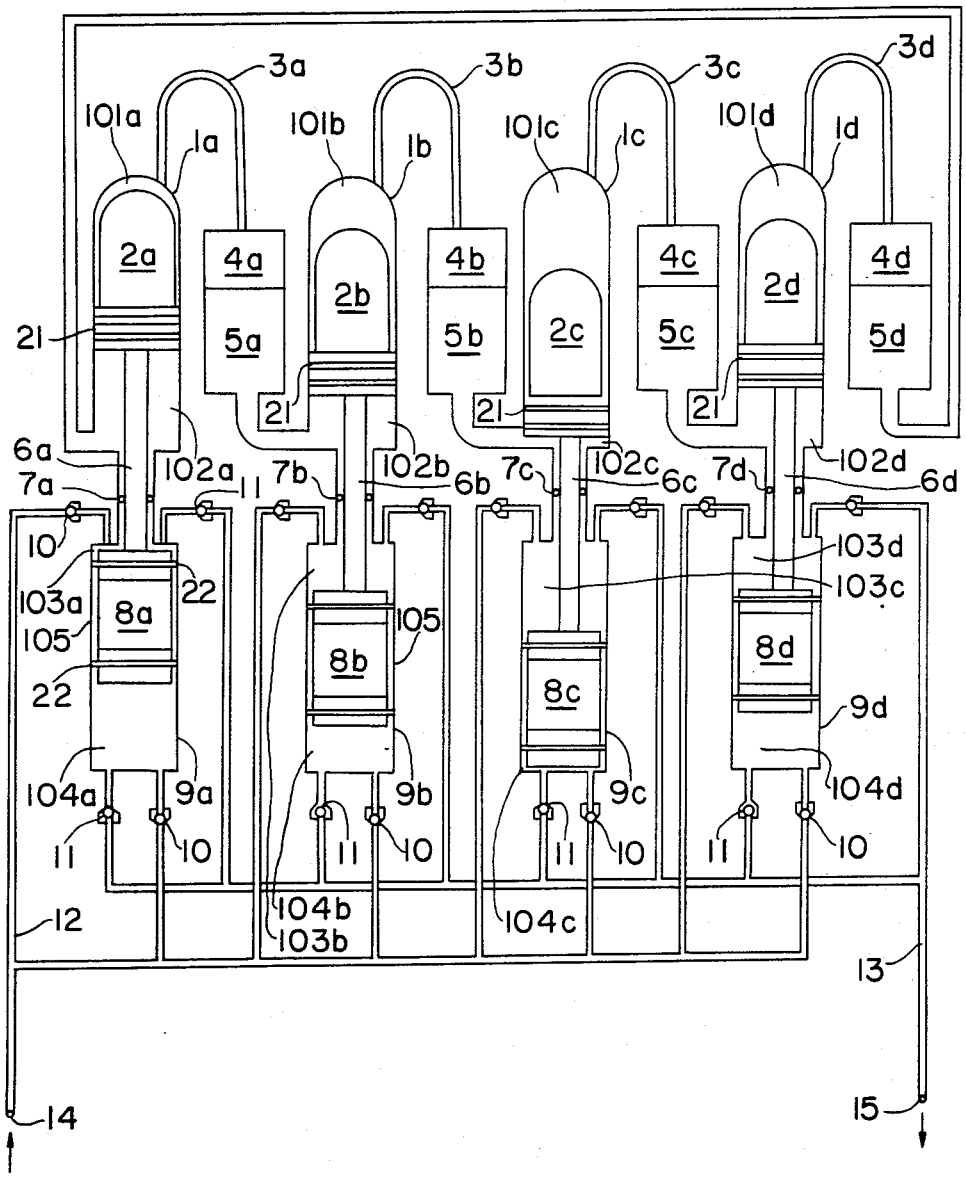
FIG. 1 is a diagrammatical illustration of an engine-compressor embodying the features of the present invention.

Referring to the drawings, particularly to FIG. 1, there is shown a stirling engine including a plurality of working cylinders 1*a*, 1*b*, 1*c* and 1*d* and a plurality of working pistons 2*a*, 2*b*, 2*c* and 2*d* disposed in respective ones of the working cylinders for axial reciprocating movements. The working pistons 2*a*, 2*b*, 2*c* and 2*d* divide the respective cylinders 1*a*, 1*b*, 1*c* and 1*d* into upper expansion spaces 101*a*, 101*b*, 101*c* and 101*d* and lower compression spaces 102*a*, 102*b*, 102*c* and 102*d*. The expansion space 101*a* in the working cylinder 1*a* is connected through a high temperature heat exchanger 3*a*, a heat accumulator 4*a* and a cooler 5*a* with the compression space 102*b* in the adjacent working cylinder 1*b*. Similarly, the expansion spaces 101*b*, 101*c* and 101*d* are respectively connected through heat exchangers 3*b*, 3*c* and 3*d*, heat accumulators 4*b*, 4*c* and 4*d*, and coolers 5*b*, 5*c* and 5*d* with the compression spaces 102*c*, 102*d* and 102*a*. The working piston 2*b* is reciprocated with a phase difference of 90° with respect to the working piston 2*a*. Similarly, the working pistons 2*c*, 2*d* and 2*a* are in phase difference by 90° with respect to the adjacent working pistons 2*b*, 2*c* and 2*d*, respectively, so that the working medium in the spaces is cyclically subjected to a stirling cycle which comprises an isothermal expansion, an isochoric depressurization, an isothermal compression and an isochoric pressurization.

Beneath the working cylinders 1*a*, 1*b*, 1*c* and 1*d*, there are provided a plurality of guide cylinders 9*a*, 9*b*, 9*c* and 9*d* which are axially aligned respectively with the working cylinders 1*a*, 1*b*, 1*c* and 1*d*. In the guide cylinders 9*a*, 9*b*, 9*c* and 9*d*, there are disposed guide pistons 8*a*, 8*b*, 8*c* and 8*d* which are axially slidable in the respective ones of the guide cylinders. The guide pistons 8*a*, 8*b*, 8*c* and 8*d* are respectively connected with the working pistons 2*a*, 2*b*, 2*c* and 2*d* by piston rods 6*a*, 6*b*, 6*c* and 6*d* so that the guide pistons reciprocate in synchronism with the respective ones of the working pistons.

Figure 2:
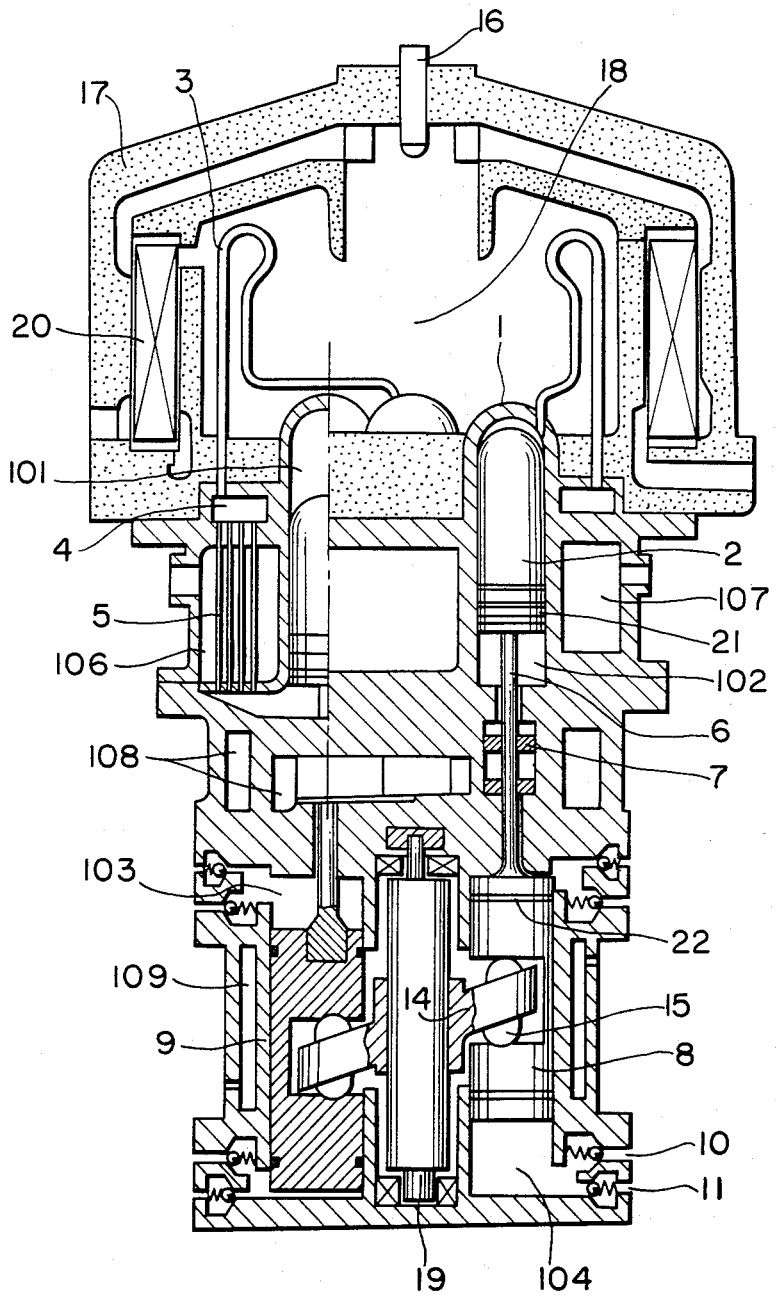
FIG. 2 is a sectional view of the engine-compressor.

Referring to FIG. 2, it will be noted that the working cylinders 1*a*, 1*b*, 1*c* and 1*d* are arranged along a circle and the expansion spaces 101*a*, 101*b*, 101*c* and 101*d* and the heat exchangers 3*a*, 3*b*, 3*c* and 3*d* are encircled by a furnace 17 which has a burner 16 and defines a combustion chamber 18. A rotatable shaft 19 is provided in parallel with the guide cylinders and coaxially with the circle along which the guide cylinders are arranged. The shaft 19 has a swash plate 14 which is engaged at the periphery thereof with the guide pistons 8*a*, 8*b*, 8*c* and 8*d* through sliding shoes 15 so that the reciprocating movements of the guide pistons are converted into rotating movements of the swash plate 14 and the shaft 19. The furnace 17 is provided with preheaters 20, and beneath the furnace 17, there are provided cooling spaces 106 for the coolers 5*a*, 5*b*, 5*c* and 5*d*, cooling jackets 107 for the working cylinders 1*a*, 1*b*, 1*c* and 1*d*, piston rod cooling jackets 108 and working medium cooling jackets 109.

The guide pistons 8*a*, 8*b*, 8*c* and 8*d* are provided with each two axially spaced piston rings 22 so that compression chambers 103*a*, 103*b*, 103*c* and 103*d* are defined in the guide cylinders 9*a*, 9*b*, 9*c* and 9*d* above the guide pistons 8*a*, 8*b*, 8*c* and 8*d*, respectively, and compression chambers 104*a*, 104*b*, 104*c* and 104*d* beneath the guide pistons. In each of the guide cylinders 9*a*, 9*b*, 9*c* and 9*d*, a swash plate space 105 is defined and the swash plate 14 is engaged with each guide piston at the swash plate space 105. Around the piston rods 6*a*, 6*b*, 6*c* and 6*d*, there are provided seals 7*a*, 7*b*, 7*c* and 7*d*, respectively so that the compression chambers 103*a*, 103*b*, 103*c* and 103*d* are separated respectively from the compression spaces 102*a*, 102*b*, 102*c* and 102*d*. Each of the compression chambers 103*a*, 103*b*, 103*c* and 103*d* and 104*a*, 104*b*, 104*c* and 104*d* is connected with an inlet conduit 12 having an inlet opening 14 through an inlet check valve 10. Further, each of the compression chambers 103*a*, 103*b*, 103*c* and 103*d* and 104*a*, 104*b*, 104*c* and 104*d* is connected with an outlet conduit 13 having an outlet opening 15 through an outlet check valve 11. It will therefore be understood that as the guide piston 8*a*, 8*b*, 8*c* and 8*d* reciprocate, air is drawn through the inlet conduit 12 and the inlet check valves 10 into the compression chambers 103*a*, 103*b*, 103*c* and 103*d*, and 104*a*, 104*b*, 104*c* and 104*d*, and compressed therein to be discharged through the outlet valves 11 and the outlet conduit 13. The structure described above is advantageous in that the guide cylinders in a stirling engine are utilized for providing a compressor so that the size and the weight of the engine-compressor can significantly be decreased. It is not necessary to provide specifically a power transmission device for driving a compressor as in a conventional engine-compressor. It should further be pointed out the overall efficiency can significantly be improved because the mechanical and power transmission losses can be substantially decreased. Vibrations and noise can also be decreased since the stirling engine does not have any explosive stroke.

Figure 3:
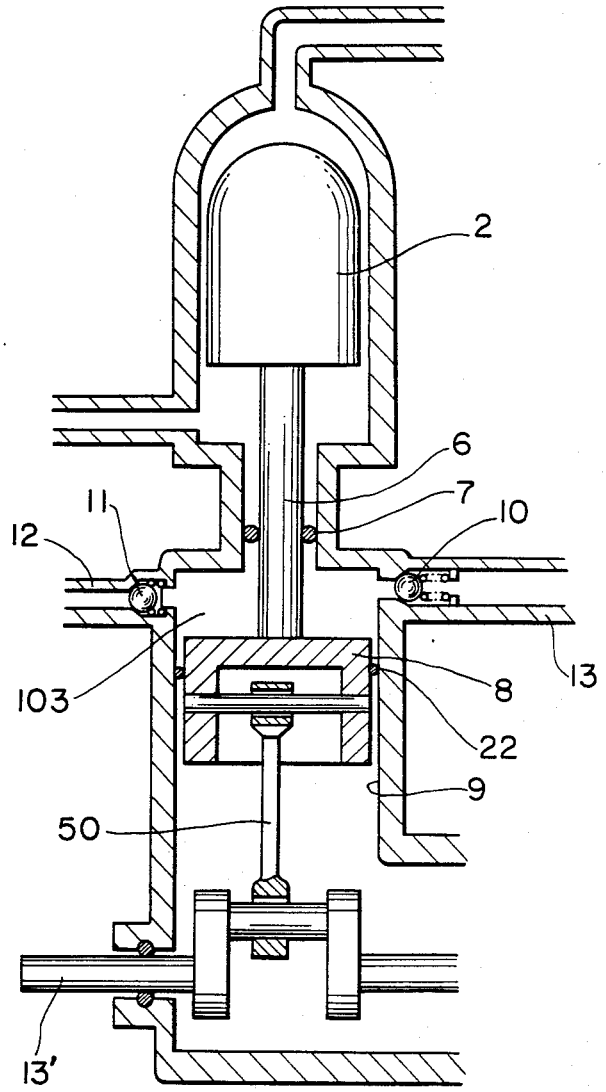
FIG. 3 is a fragmentary sectional view showing another embodiment of the present invention.

FIG. 3 shows another embodiment of present invention. In this embodiment, each of the guide pistons 8 disposed in a guide cylinder 9 is connected through a connecting rod 50 with a crankshaft 13' and a compression chamber 103 is defined only above the guide piston 8. In other respects, the arrangements are the same as in the previous embodiment.

The invention has thus been shown and described with reference to specific embodiments, however, it should be noted that the invention is in no way limited to the details of the illustrated structures but changes and modifications may be made without departing from the scope of the appended claims.

We claim:

1. An engine-compressor comprising a stirling engine which includes a plurality of working cylinders arranged on a circle with the same phase angle difference, a plurality of working pistons respectively disposed in said working cylinders for axial reciprocating movements to thereby divide each of the cylinders into an expansion space and a compression space, the expansion space in one of the cylinders being connected through heating means and heat accumulating means with the compression space in another cylinder, a plurality of guide cylinders, a plurality of guide pistons disposed respectively in said guide cylinders for axial reciprocating movements due to the axial movement of the working pistons, said guide pistons being connected through piston rods with respective ones of the working pistons and defining in the respective guide cylinders compression chambers located at the opposite sides of the respective guide pistons, intake valve means provided in said compression chamber for admitting air or coolant thereto to be compressed by said guide piston, and outlet valve means provided in said compression chamber for removing compressed air or coolant from the compression chamber, and a swash plate operably connected to said guide pistons to be driven thereby, independently of the compressed air from said compression chambers, for converting the axial reciprocating movement of said guide pistons into rotating movement.

2. An engine-compressor in accordance with claim 1, wherein said swash plate is rotatable about an axis parallel with the cylinders and passing through the center of the circle along which the working cylinders are arranged, said swash plate being slidably engaged at its periphery with the guide pistons.

3. An engine-compressor in accordance with claim 1 in which said intake valves means is in the form of a check valve which opens only in the direction of the compression chamber.

4. An engine-compressor in accordance with claim 3 in which said outlet valve means is also in the form of a check valve which allows an airflow out of the compression chamber.

* * * * *